US008484867B2

(12) United States Patent
Roselle et al.

(10) Patent No.: US 8,484,867 B2
(45) Date of Patent: Jul. 16, 2013

(54) FABRIC REFRESHING CABINET DEVICE FOR INCREASING FLEXURAL RIGIDITY

(75) Inventors: Brian Joseph Roselle, Fairfield, OH (US); Laura Marie Tanno-Smith, Cincinnati, OH (US); Tara Lynn Armstrong, Liberty Township, OH (US); Helen Frances O'Connor, Cincinnati, OH (US); Morgan Thomas Leahy, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 503 days.

(21) Appl. No.: 12/791,123

(22) Filed: Jun. 1, 2010

(65) Prior Publication Data

US 2010/0299976 A1 Dec. 2, 2010

Related U.S. Application Data

(60) Provisional application No. 61/183,047, filed on Jun. 1, 2009.

(51) Int. Cl.
*D06F 58/10* (2006.01)
*D06F 58/26* (2006.01)

(52) U.S. Cl.
USPC ..... 38/14; 38/1 A

(58) Field of Classification Search
USPC ..... 38/1 A, 14, 7, 10, 1 C, 1 D; 34/77, 34/202, 224, 237; D32/1, 8
See application file for complete search history.

(56) References Cited

U.S. PATENT DOCUMENTS

| | | | | |
|---|---|---|---|---|
| 380,949 | A * | 4/1888 | Shannon | 432/162 |
| 1,013,042 | A * | 12/1911 | Mossop | 223/75 |
| 4,566,149 | A | 1/1986 | Fitzwater | |
| 4,682,424 | A * | 7/1987 | Irving | 34/621 |
| 5,085,358 | A | 2/1992 | Lam | |
| 5,253,494 | A | 10/1993 | Frucco et al. | |
| 5,305,484 | A | 4/1994 | Fitzpatrick et al. | |
| 5,344,054 | A | 9/1994 | Nutter | |
| 5,369,892 | A | 12/1994 | Dhaemers | |
| 5,511,701 | A | 4/1996 | Lam | |
| 5,664,710 | A | 9/1997 | Lam | |
| 5,815,961 | A | 10/1998 | Estes et al. | |
| 6,189,346 | B1 | 2/2001 | Chen et al. | |
| 6,386,392 | B1 | 5/2002 | Argentieri et al. | |
| 6,491,840 | B1 | 12/2002 | Frankenbach et al. | |
| 6,495,058 | B1 | 12/2002 | Frankenbach et al. | |

(Continued)

FOREIGN PATENT DOCUMENTS

| | | | |
|---|---|---|---|
| DE | 4435672 | C2 | 6/1995 |
| DE | 29713157 | U1 | 10/1997 |

(Continued)

OTHER PUBLICATIONS

U.S. Appl. No. 12/475,689, filed Jun. 1, 2009, Roselle, et al.

(Continued)

*Primary Examiner* — Ismael Izaguirre
(74) *Attorney, Agent, or Firm* — Gary J. Foose

(57) ABSTRACT

A device for refreshing fabrics. The device provides fabrics with a crisp and fresh appearance and feel. The device also controls wrinkles on fabric without the use of a conventional iron or press. The device also allows for the delivery of fabric refreshing actives such as perfumes and other actives to fabrics.

33 Claims, 6 Drawing Sheets

U.S. PATENT DOCUMENTS

| | | | | |
|---|---|---|---|---|
| 6,628,908 | B2 | 9/2003 | Matsumoto et al. | |
| 6,726,186 | B2 | 4/2004 | Gaaloul et al. | |
| 6,745,496 | B2 | 6/2004 | Cassella | |
| 6,817,497 | B2 | 11/2004 | Grasso et al. | |
| 6,840,068 | B2 | 1/2005 | Pasin et al. | |
| 6,840,589 | B2 * | 1/2005 | Uri | 312/228.1 |
| 6,925,737 | B2 | 8/2005 | Bolduan et al. | |
| 6,964,360 | B2 | 11/2005 | Tubman et al. | |
| 6,971,549 | B2 | 12/2005 | Leifheit et al. | |
| 6,971,589 | B2 | 12/2005 | Incardona | |
| 6,973,740 | B2 * | 12/2005 | Meyer | 34/224 |
| 7,043,855 | B2 | 5/2006 | Heilman et al. | |
| 7,137,211 | B2 | 11/2006 | Johnson et al. | |
| 7,140,121 | B2 | 11/2006 | Casella | |
| 7,308,990 | B2 | 12/2007 | Mazooji et al. | |
| 7,328,822 | B2 | 2/2008 | Stokes | |
| 7,367,137 | B2 | 5/2008 | Jonsson et al. | |
| 7,739,891 | B2 | 6/2010 | Luckman et al. | |
| 7,913,419 | B2 * | 3/2011 | Tomasi et al. | 34/595 |
| 8,058,588 | B2 * | 11/2011 | Gagas et al. | 219/400 |
| 2004/0163184 | A1 | 8/2004 | Waldron et al. | |
| 2005/0023310 | A1 | 2/2005 | Noda | |
| 2005/0120757 | A1 | 6/2005 | Jackson | |
| 2005/0257440 | A1 | 11/2005 | Seiffert et al. | |
| 2005/0262671 | A1 | 12/2005 | Redlin | |
| 2007/0020040 | A1 | 1/2007 | Sacks | |
| 2007/0108310 | A1 | 5/2007 | Tollens et al. | |
| 2007/0266740 | A9 * | 11/2007 | Kendall et al. | 68/3 R |
| 2008/0000616 | A1 | 1/2008 | Nobile | |
| 2008/0256989 | A1 | 10/2008 | Jeong et al. | |
| 2009/0038083 | A1 | 2/2009 | Roselle et al. | |
| 2009/0126421 | A1 * | 5/2009 | Kim et al. | 68/5 |
| 2009/0133298 | A1 | 5/2009 | Kim et al. | |
| 2009/0241268 | A1 | 10/2009 | Yoo et al. | |
| 2009/0241269 | A1 | 10/2009 | Yoo et al. | |
| 2010/0018262 | A1 | 1/2010 | Beihoff et al. | |
| 2010/0043247 | A1 | 2/2010 | Park et al. | |
| 2010/0186176 | A1 | 7/2010 | Wright et al. | |

FOREIGN PATENT DOCUMENTS

| | | | |
|---|---|---|---|
| EP | 0 587 173 | A1 | 3/1994 |
| EP | 0 670 135 | A1 | 9/1995 |
| EP | 0 683 999 | A1 | 11/1995 |
| EP | 0 812 556 | A2 | 12/1997 |
| EP | 0 953 669 | B1 | 9/2003 |
| EP | 1 528 145 | A2 | 5/2005 |
| EP | 1 288 367 | B1 | 8/2005 |
| GB | 2 189 522 | A | 10/1987 |
| GB | 2 321 954 | A | 8/1998 |
| GB | 2 377 927 | A | 1/2003 |
| GB | 2 394 271 | A | 4/2004 |
| JP | 10156096 | A2 | 6/1998 |
| JP | 11057299 | A2 | 3/1999 |
| WO | WO 99/49123 | A1 | 9/1999 |
| WO | WO 00/19001 | A1 | 4/2000 |
| WO | WO 02/072940 | A1 | 9/2002 |
| WO | WO 2006/073885 | A | 7/2006 |
| WO | WO 2009/064096 | A1 | 5/2009 |

OTHER PUBLICATIONS

U.S. Appl. No. 12/564,946, filed Sep. 23, 2009 Smith, et al.
U.S. Appl. No. 12/636,998, filed Dec. 14, 2009 Smith, et al.
U.S. Appl. No. 12/731,159, filed Mar. 25, 2010 Meschkat, et al.
U.S. Appl. No. 12/791,135, filed Jun. 1, 2010 Hollinger, et al.
U.S. Appl. No. 12/767,974, filed Apr. 27, 2010 Roselle, et al.
International Search Report—6 Pages, Oct. 6, 2010.

* cited by examiner

FABRIC REFRESHING CABINET DEVICE FOR INCREASING FLEXURAL RIGIDITY

CROSS-REFERENCES TO RELATED APPLICATIONS

The present application claims the benefit of U.S. Provisional Application Ser. No. 61/183,047 filed Jun. 1, 2009.

BACKGROUND OF THE INVENTION

Consumers have been found to desire their fabrics, such as garments to appear and feel crisp and freshly pressed prior to wear. Current ways to prepare fabrics such as garments include washing and drying, followed by ironing or pressing or taking the fabrics to the dry cleaners. Some manufacturers have recently marketed fabric treatment devices to reduce odors and wrinkles. These devices typically use steam or a misting mechanism to wet the fabrics then allow the fabrics to dry within the device. Although these devices are described to provide freshening and dewrinkling benefits, it has been found that the devices do not provide sufficiently crisp appearance and feel within a sufficient amount of time and energy use.

Steam based devices for treating fabrics typically heat a volume of water to boiling point, thereby generating steam. Heating the water to boiling point requires a considerable amount of energy and heat. Further, the heating device used by the apparatus requires a certain amount of time to reach the temperature required to heat the water to boiling temperature. Typically, the device does not activate the heating element until the user inserts clothing and turns the device on. This process typically takes a long time to run and complete the treatment cycle. Consumers have been found to desire the treatment to be completed in a short amount of time such that the fabrics can be treated within the amount of time it would typically take a consumer to prepare in the morning. A steam based fabric treatment device is described in U.S. Pat. No. 5,815,961 issued to Estes et al.

Another type of fabric treating device which distributes fluids, such as water and/or chemical compositions, onto the fabrics by misting within the device or distributing the fluid directly onto the fabrics is U.S. Pat. No. 6,189,346 issued to Chen et al. One known problem with this approach is that the mist may undesirably collect unevenly at certain portions of the fabrics depending on the flow of air within the device. Another problem is that the device may take an undesirably long amount of time to sufficiently wet the fabrics as the mist circulating within the device is difficult to control and direct onto the fabrics within the device.

Yet another type of fabric treating device involves the use of ultrasonic nebulizers to distribute the fluids onto the fabrics are known. See e.g. U.S. Pat. No. 6,726,186 to Gaaloul et al.; and U.S. Pat. No. 7,367,137 Jonsson et al. One drawback to ultrasonic nebulizers is that the ultrasonic nebulizers are typically designed for low flow rates, such as low as 2 grams of fluid/minute per nebulizer head. Increasing the flow rates has been found to be problematic as increased flow through the nebulizer could result in insufficient fluid distribution. The insufficient fluid distribution leads to certain portions of the fabrics not being properly treated and can require increased run time to dry excessively wetted portions of the fabrics.

Despite these and other attempts to provide fabric refreshing devices, there remains a need for a device which provides sufficient crispness appearance and feel within a short amount of time and is energy efficient.

SUMMARY OF THE INVENTION

One aspect of the present invention provides for a device which is a refreshing cabinet, the refreshing cabinet comprising: a shell comprising an opening; and an extractable drawer adapted to fit the opening, the extractable drawer comprising: a drawer face comprising an outer surface; a supporting member for suspending a fabric or a fabric hung upon a fabric hanging member such as a hanger, wherein the drawer face and the supporting member form a receiving region adapted to operably support a fabric; a heating element contained within the shell; and an air flow path positioned to direct air through the receiving region, wherein the device has a 10 minute flexural rigidity increase of at least about 50%, in accordance with the FLEXURAL RIGIDITY TEST METHOD without tensioning, as defined herein.

Another aspect of the present invention provides for a refreshing cabinet having a wrinkle improvement grade of at least about 0.5 to about 3 in accordance with the WRINKLE TEST METHOD with tensioning as defined herein.

DETAILED DESCRIPTION OF THE INVENTION

Figure 1:
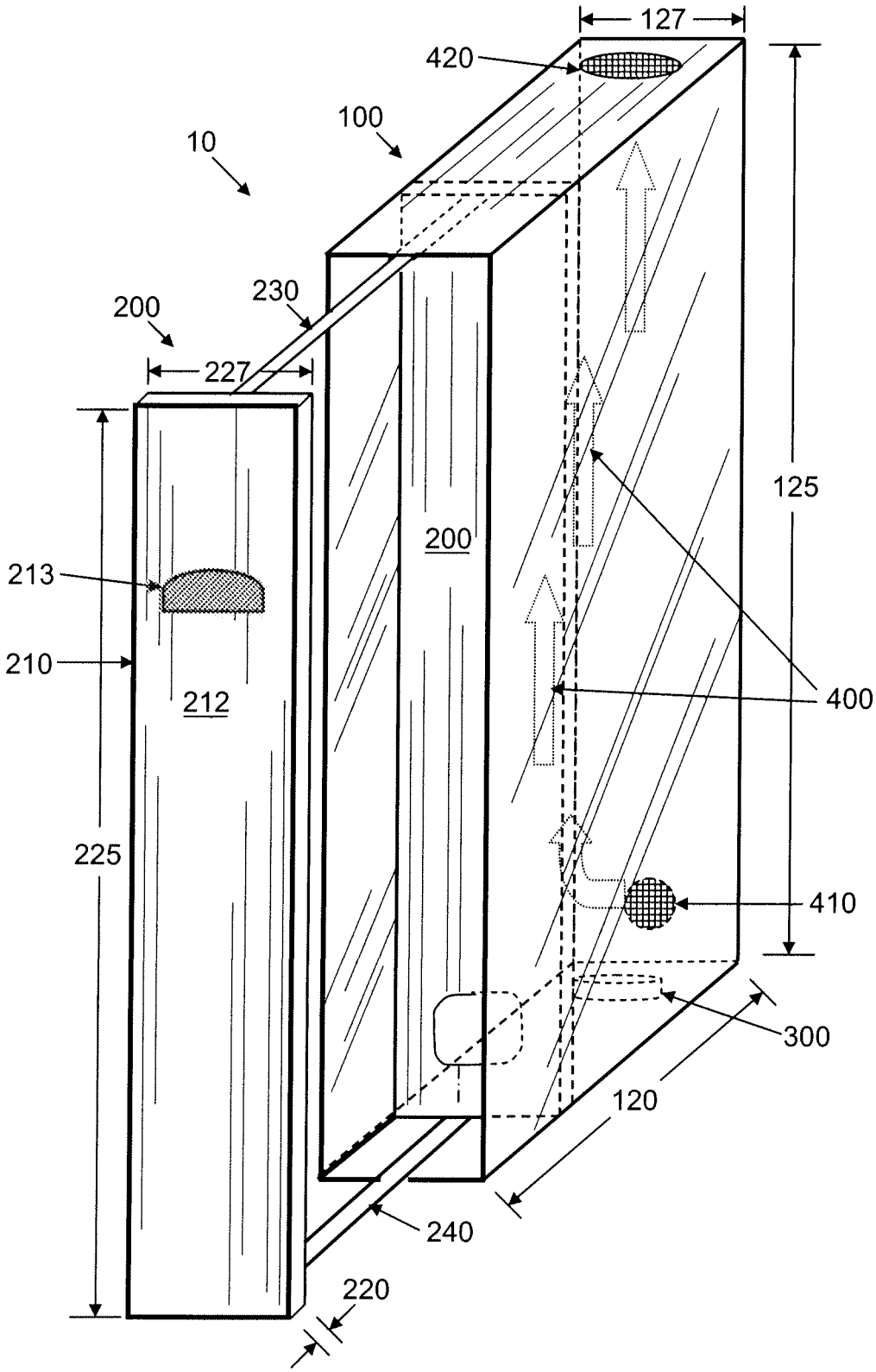
FIG. 1 is a perspective view of a device in accordance with at least one embodiment of the present invention wherein the extractable drawer is in a partially opened position.

As defined herein, crispness is a measure of the fabric feel and appearance which is believed to correlate to the flexural rigidity of the fibers. Flexural rigidity, having units of ujoule/m, as defined herein is measured in ujoule/m by the FLEXURAL RIGIDITY TEST METHOD defined herein.

Without intending to be bound by theory, it is believed that the crispness, as measured by flexural rigidity on cotton containing fabrics, is achieved by the process of removal of the moisture that is in or applied to the fabric facilitating the formation of hydrogen bonds within the cellulose polymer structure as water is removed. Formation of hydrogen bonds in the process is believed to establish the flexural rigidity of the fabric. The process of moisture removal can be achieved by passing air with low relative humidity over the fabric to remove the water. Warming ambient air to reduce relative humidity is a preferred way to achieve this effect and it has the added advantage of providing a warm sensation to the finished fabric as well. Adding tension is believed to help the fabric become crisp and dewrinkled in appearance and feel. Additionally, it is believed that the added tension may facilitate compressing the fibers together with a greater surface area of contact which would allow additional formation of hydrogen bonds.

Importantly, it has been found that a fabric can be made to have sufficient flexural rigidity such that it feels and appears crisp and is dewrinkled such that it can appear freshly pressed and/or ironed without the use of direct applied heat such as by a conventional iron or heated press, with our without steam. Importantly, this is believed to be achieved by the present device which is free of a pressing or ironing step or mechanism.

The present invention provides for a device for treating fabrics comprising: a shell which may be in the form of a non-collapsing cabinet comprising an opening; and an extractable drawer comprising: a drawer face comprising an outer surface; a supporting member such as a rod, pole, beam, hooks or other member capable of suspending a fabric or a fabric hung upon a fabric hanging member such as a hanger, wherein the drawer face and the supporting member form a receiving region adapted to operably support a fabric, and wherein the extractable drawer is adapted to fit within the shell; a heating element contained within the device; and an air flow path positioned to direct air through the receiving region, wherein the device provides a flexural rigidity increase as defined herein. It has importantly been found that the present invention provides users with a versatile device which can refresh, dewrinkle, and provide additional benefits to fabrics such as clothing and other textiles in a quick and efficient manner. Further, the extractable drawer of the present invention provides users with a simple yet user friendly way to load the cabinet with fabrics without having to reach into the device and potentially touch or brush up against interior shell walls of the device which may have a greasy or filmy feeling residue left over from an earlier use. As used herein, fabrics include one or more items of clothing, garments, textiles, towels, table cloths, drapes, chair covers, and the like. As defined herein, "operably support" means that the suspending member is capable of directly supporting a fabric hung thereon, or of supporting a fabric hanging member which can have a fabric hung thereon.

In one non-limiting embodiment, the device comprises a footprint which is compact in width such that the device can be used in a bedroom, closet or other living space where larger wider devices are inconvenient. The small footprint width of the present device is achieved from the extractable drawer design. The present invention occupies less horizontal floor space compared to devices which include a hinged door because the extractable drawer consumes the same or a smaller horizontal footprint compared to the shell of the cabinet compared to conventional hinged doors which include a wider footprint from the sweeping action of the hinged doors. As such, the present device is more compact and convenient to use in various rooms of the home. Further, the present device is believed to appear more streamlined than conventional devices and is suitable for use in varying rooms in a home and provides sufficient spray or misting capability to effectively wet the fabrics quickly, yet still achieves an effective distribution of the composition.

It has been determined that it may be desirable to construct the shell to have a larger peripheral size than the drawer face of the extractable drawer, when the device is viewed facing the drawer face of the expandable drawer. In one non-limiting embodiment, at least one portion of the shell extends laterally or horizontally beyond the periphery of the drawer face of the extractable drawer, such as when the device is viewed in a frontal view. See e.g. FIG. 2. In one embodiment, one or both of the sides of the shell extend beyond the periphery of the drawer face of the expandable drawer. In yet another embodiment, the side portions of the shell further comprise one or more side protrusions which further extend beyond the periphery of the drawer face and provide greater lateral distance from the receiving region of the extractable drawer. By extending the lateral width of the device, the present invention is able to facilitate the inclusion of dispensing heads (including but not limited to sprayer heads, hydraulic nozzles, sonic or ultrasonic nebulizers, pressure swirl atomizers, high pressure fog nozzle, and combinations thereof) positioned at a desired distance from any fabrics contained within the device. Extending the periphery of a portion of the shell beyond the periphery of the drawer face of the extractable drawer allows the device to increase the distance between the dispensing heads to the fabrics without requiring that the entire device be made to have an unnecessarily large width. Further, by minimizing the width of the drawer face, yet providing for a shell which extends laterally or horizontally beyond the periphery of the device, or one or more side protrusions, the device appears thinner, yet can still achieve sufficient composition distribution onto the fabrics.

Figure 10:
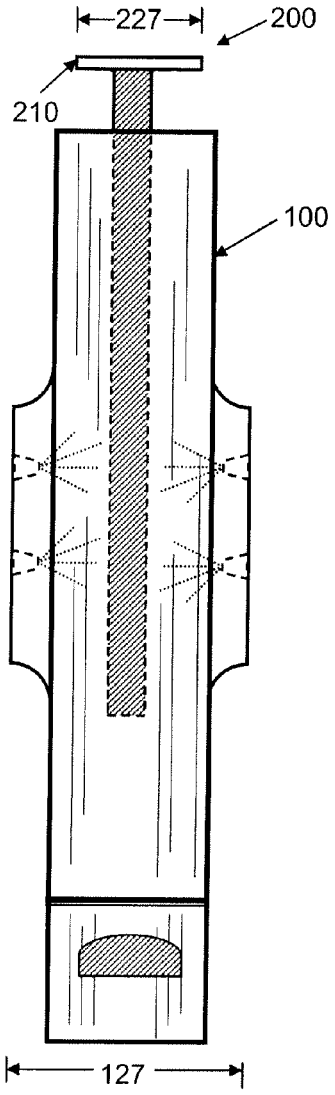
FIG. 10 is a frontal view of a device in accordance with at least one embodiment of the present invention, wherein the extractable drawer extends out vertically.

FIG. 1 is a perspective view of a device 10 for treating fabrics comprising a shell 100 forming at least one opening, wherein the extractable drawer 200 is in a partially opened position. In this embodiment, the extractable drawer is shown as a frontal drawer which can be pulled out or actuated out of the opening formed in the shell via any suitable mechanical or manual means. Non-limiting examples of mechanical means to extract the drawer include spring loaded drawers, chain driven drawers, and levered drawers. In another non-limiting embodiment, the extractable drawer can be positioned to exit the shell in an upwards or vertical direction as opposed to a lateral or horizontal direction. See FIG. 10 compared with FIG. 1. In one embodiment, the extractable drawer comprises one or more sliding members such as a wheel or glide with or without roller bearings, which can be adapted to slide along a rail provided from the shell. In one non-limiting embodiment the shell is a non-collapsing member comprising a pair of side walls, a top, a front wall, a rear wall and a base wall, wherein at least a portion of one of the top, front wall and rear wall can be formed from the drawer face of the extractable drawer. The extractable drawer 200 comprises a drawer face 210 having an outer surface 212. In one embodiment, the drawer face at least partially seals the opening of the shell in a closed position. Where the drawer face does not fully seal the opening of the shell, a gap in the seal can perform the function of an inlet and/or outlet vent in the venting system of the device. In another non-limiting embodiment, the drawer face fully seals the shell in a closed position. In yet another embodiment, the outer surface of the drawer face forms a flush closure with the shell.

The extractable drawer is shown with an optional handle 213 for accessing the extractable drawer from the interior of the shell. The extractable drawer further comprises a supporting member 230 which can operably support one or more fabrics, the drawer face supporting member forms a receiving region for the fabric. Non-limiting examples of suitable supporting members include a rod, pole, beam, rope, cord, or hooks extending from the drawer face into the interior of the shell. In one non-limiting embodiment, the supporting member further comprises a hook or notch to support a fabric hanging member such as a hanger. In another non-limiting embodiment, the supporting member supports a hanger fixedly or removably attached to the supporting member. In another non-limiting embodiment, the supporting member further comprises a telescoping section which allows the supporting member to be extended or retracted. In one non-limiting embodiment, the device further comprises a tensioning system which can assist in the removal of wrinkles from the entire fabric or a discrete section of the fabric. In one non-limiting embodiment, the tensioning system is provided by the hanger in conjunction with the extractable drawer. Suitable tensioning devices known in the art include expanding hangers, hanging weights or poles or rods which can be used to drape or stretch the fabrics over and/or around. Additional non-limiting examples of tensioning systems are disclosed below.

The extractable drawer is shown with an optional rear face 220 and an optional base 240. In this position, the rear face is contained within the shell such that the extractable drawer is not fully detached from the device. In one non-limiting embodiment, the extractable drawer is a fully detachable drawer meaning that it can be removed from the shell. In another non-limiting embodiment, the extractable drawer is movable but attached to the shell such that the extractable drawer can be slidably contained within the shell but cannot be completely removed. The drawer face 210 is shown connected to the rear face 220 by the supporting member 230. Although the supporting member shown in FIG. 1 is shown attached to both the drawer face and the optional rear face, the supporting member can be connected to either of the drawer face or the optional rear face. Alternately, the supporting member may be hingedly attached to either of the drawer face and the rear face. One important benefit obtained by providing a rear face which fits within the interior space of the shell, the user is limited in exposure to the condition of the side walls or any tubes or wires provided therein. It is believed that upon repeated use, the interior of the side walls can collect residue or buildup from the fabric treatment composition sprayed or misted within the device and evaporated from the fabrics. By providing a rear face in the extractable drawer, the user exposure to the interior of the side walls is limited. Further, the rear face adds an aspect of safety as the user cannot access any tubes, hoses, wires or electronics contained with the shell.

The device shown in FIG. 1 further comprises a heating element 300 and an air flow path 400. When the extractable drawer is in a closed position, the air flow path directs at least a portion of the air to and/or through the receiving region. The heating element can be positioned within the shell at any location which allows the heating element to transfer heat, either through convection, conduction, or radiation, to the interior of the shell, particularly to the receiving region, more particularly to any fabrics contained within the receiving region. Suitable heating elements include but are not limited to a heating wire or coil, an infrared lamp, a microwave heating element, and combinations thereof. In this embodiment, the heating element 300 can be provided to be flush with the lower portion of the shell such that it does not obstruct the closing of the extractable drawer when the rear face is moved towards the back of the shell.

The air flow 400 is facilitated by a venting system comprising an inflow vent 410 and an outflow vent 420. In one embodiment, the inflow vent is positioned below the outflow vent. This is believed to allow for natural convection and movement of the heated air to escape without the need for active air flow. In another embodiment, the inflow vent is poisoned above the outflow vent. Air flowing from the inflow vent to the outflow vent can be by natural convection or via forced draft. In the case of forced draft, a fan or other forced air movement means can be inserted in the air flow path. The fan may be near the inflow vent 410 or the outflow vent 420 in order to avoid interference with the sliding door mechanism. The air flow means can be of any design but typically will be a fan of radial, centrifugal, or crossflow blower design as needed to achieve the desired flow rate.

In one non-limiting embodiment, the outflow vent comprises an air filter system such as a charcoal filter. The air filter system can be used to capture malodors from the treated fabrics or interior of the device and/or used to capture excessive fragrance or perfumes provided from the fabric treatment composition. Without intending to be bound by theory, it is believed that by providing an air filter system in the outflow vent, any malodors released from the fabrics will not be released into the ambient air surrounding the device. This is particularly desirable when the device is used in the home in the bedroom or other rooms where the released malodors may be noticeable. The air filter system may be replaceable. In another non-limiting embodiment, the outflow vent comprises a chemical capture member to remove moisture and/or other materials from the effluent. In another non-limiting embodiment, the device further comprises an air filtering and/or treatment system. In one non-limiting embodiment the inflow vent can be positioned below the outflow vent such that cool ambient air can be sucked into the shell by the movement of the heated air within the device (heated by the heating element 300). The heated air moving up the receiving region will pass over and through any fabrics located in the receiving region allowing the fabrics to dry. Without intending to be bound by theory, it is believed that the heat allows for control or killing of certain microorganisms and bacteria as well as removal of odor causing entities which can be present on the fabrics. This anti-microbial benefit is believed to be the result of subjecting the fabrics to a sufficiently high temperature to control, remove, and possibly kill the microorganisms and/or bacteria.

In one non-limiting embodiment the air treatment (freshening, deodorizing, disinfecting, etc.) system is part of or, provided in the vicinity of, the outflow vent such that air expelled from the device carries with it air treatment ingredients. Non-limiting examples of suitable liquid active materials comprise perfumes, air fresheners, deodorizers, odor eliminators, malodor counteractants, household cleaners, disinfectants, sanitizers, repellants, insecticide formulations, mood enhancers, aroma therapy formulations, therapeutic liquids, medicinal substances, or mixtures thereof. These and other suitable actives are disclosed in U.S. Pat. No. 7,490,815 issued in the name of Tollens et al. In one non-limiting embodiment, the device allows the consumer to manually or automatically determine the dosage rate and/or frequency of doses for emitting the air treatment composition. Although the air treatment device can be part of the outflow/venting system (such as by using the expelled air to emit the air treatment ingredients) the air treatment device can also be a separate element from the outflow venting system.

Those of skill in the art will understand that where a vent or heating element is provided in the device in the vicinity of the rear face when the device is in a closed or operating position, the rear face is designed such that air and/or heat can pass through the one or more apertures formed in the rear face to enter the receiving region and fabrics supported within the device. As such, in one non-limiting embodiment, the rear face comprises one or more apertures positioned to facilitate the passage of the air through the air flow, and to allow heat to enter the receiving region and to exit the device with any evaporated fabric treatment composition and malodors. Further, where internal parts such as wires and dispensing heads are provided in the interior of the device, the rear face is operably designed such that upon opening and closing the extractable drawer, the rear face does not strike any internal parts of the device. In yet another non-limiting embodiment, the opening or closing of the extractable drawer further actuates other elements which would allow the device to begin running.

The device depth 12 (not shown) can be calculated by measuring the total depth of the device when the extractable drawer is in a closed position within the shell. In one non-limiting embodiment, where the drawer face does not recede into the shell, the device depth would be equal to the sum of the shell depth 120 and the drawer face depth 220. Where the drawer face recedes into the shell such that the outer surface of the drawer face is flush with the shell, the device depth is equal to the shell depth 120. In one embodiment, the device depth is from about 24 inches (61 cm) to about 60 inches (152 cm), alternatively from about 30 inches (76 cm) to about 48 inches (122 cm), or alternatively from about 36 inches (91 cm) to about 42 inches (107 cm). The shell also comprises a height 125.

Further, as shown in this embodiment, the shell has a width 127 and the drawer face has a width 227. In one embodiment, the device has a greatest lateral width of less than about 28 inches (71 cm), alternatively less than about 20 inches (51 cm), alternatively less than about 16 inches (41 cm), or alternatively less than about 12 inches (31 cm). As defined herein, the greatest lateral width is determined when the device is viewed in a frontal view. The greatest lateral width can be measured at the base, the shell or any protrusions extending away from the shell, or the drawer face of the extractable drawer, depending on which element has the greatest width. In one embodiment, the device comprises a width ratio, as defined by the ratio of the greatest lateral width of the device to the greatest lateral width of the drawer face of the extractable drawer, of from about 9 to about 1, alternatively from about 4 to 1.2, or alternatively from about 2 to 1.5.

Importantly, it has been found that by providing a device having a width ratio of less than about 2, it provides the desired appearance that the device has the general width of the door, yet allows for an increase in the distance from the fabrics located in the receiving region to the position of the sides of the device where the dispensing heads are located.

In one non-limiting embodiment the device comprises a footprint aspect ratio of from about 1 to about 30, alternatively from about 2 to about 15, alternatively from about 3 to about 10, alternatively about 5. The footprint aspect ratio is a ratio of the greatest lateral length of the device 10 to the greatest lateral width of the device 10, such as from the optional base stand or the shell width. It has surprisingly been found that the present invention is versatile and can be suitably placed in many different areas when used in a domestic capacity. For example, the present device can be placed alongside a conventional washer and/or dryer device when used in the laundry area of a home. Importantly, by providing a device which has a footprint aspect ratio as defined herein, the device is versatile and can be used and fit into small spaces such as in the bedroom or other living area, along side a wall or within a closet. The device can be placed alongside a cabinet, dresser, TV stand, or couch. Importantly, when the device is opened, the footprint width does not increase. Devices which include one or more hinged doors or releasably sealed openings, such as by zipper, attached to a cabinet require larger footprint widths because the doors or openings tend to swing or drape beyond the width of the device when in a open position. It is believed that by providing a device having the dimensions as defined herein, the appearance of the device is considerably less obtrusive compared to fabric treatment and refreshing devices disclosed in the art. It is also believed that by providing a device having the dimensions as defined herein, the device will be more readily and conveniently used in the bedroom or other living areas, making the device more readily accessible to a user during the act of dressing, undressing, changing-clothes and the like.

Figure 2:
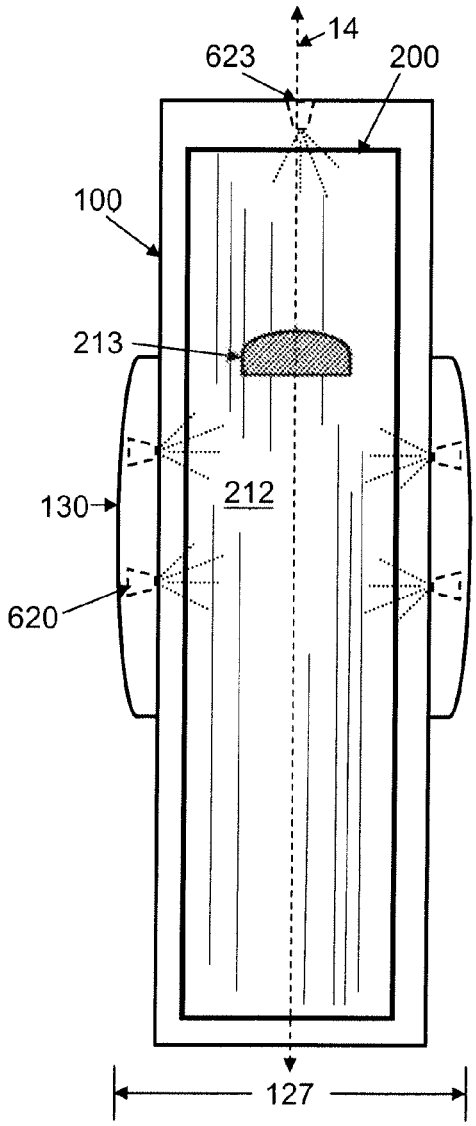
FIG. 2 is a frontal view of a device in accordance with at least one embodiment of the present invention, wherein the extractable drawer is in a closed position.

FIG. 2 is a frontal view of a device in accordance with the present invention, wherein the extractable drawer 200 is in a closed position. The shell 100 can comprise a larger width than the drawer face of the extractable drawer. In one embodiment, the device further comprises one or more protrusions extending beyond the frontal planar periphery of the drawer face 210. In this embodiment, the protrusion comprises the shell 100, shown having a larger width, height than the drawer face. In addition, FIG. 2 shows two additional side protrusions 130 formed on the side walls of the shell. As such, the shell width 127 is now measured as the widest lateral distance between the two points on opposing sides of the shell when measured on a plane perpendicular to the center line 14 of the device. As defined herein, the center line is the central axis of the device. The side protrusions can be provided in a variety of suitable shapes which allow for a slight increase in the distance between dispensing heads and suspended fabric.

The device of the present invention further comprises a plurality of dispensing heads 620 positioned on the side walls of the shell 200. In one suitable embodiment, the dispensing heads comprises one or more sprayer heads and optionally one or more ultrasonic nebulizers. Dispensing heads are preferred where the flow rate of the fabric treatment composition is desired to be high, for example greater than 2 grams of fluid per minute per nozzle. Non-limiting examples of suitable dispensing heads and sprayer heads are provided in U.S. Application Ser. No. 61/163,924 filed Mar. 28, 2009 in the name of Meschkat et al. In one non-limiting embodiment, where the device comprises one or more of the side protrusions 130, one or more of the dispensing heads 620 can be positioned on the interior of the side protrusion to increase the lateral distance between the head 620 and any fabric contained with in the receiving region. Those of skill in the art will understand that by providing two or more sets of dispensing heads positioned on each side wall of the shell, the fabric can be wetted in a faster more efficient manner. Further, by increasing the horizontal distance between the dispensing heads and the fabric, the dispensed fluid has more space to disperse and cover more area on the fabric.

In one non-limiting embodiment, the device comprises a lateral distance between the receiving region where a fabric is placed (which can be determined as the central line or axis 14 of the device) and at least one dispensing head positioned on either a side wall of the shell or on a side protrusion of less than about 12 inches (30 cm), alternatively less than about 8 inches (20 cm), alternatively less than about 6 inches (15 cm) and at least about 4 inches (10 cm), alternatively at least about 6 inches (15 cm), or alternatively at least about 10 inches (25 cm). FIG. 2 further shows an optional dispensing heads 623 positioned at the top of the shell, oriented to spray downwards onto any fabric within the device. Additional spray heads can be placed throughout the interior of the device such as on the interior portion of the drawer face or rear face, or base 240 where the dispensing heads are preferably situated for maximum fabric coverage, avoiding spray interference by any of the supporting members.

In one non-limiting embodiment where the dispensing heads comprise one or more sprayer heads, the sprayer heads may comprise one or more spray nozzles, such as 2, 3, 4, 5, or 6 spray nozzles. Multiple sprayer nozzles in the sprayer head allow for effective distribution of a benefit composition directly to a garment to be treated to minimize application time. Dispensing of a benefit composition can be achieved using any suitable device such as a hydraulic nozzle, sonic or ultrasonic nebulizers, pressure swirl atomizers, high pressure fog nozzle or a combination thereof, to deliver target particle sizes and coverage pattern. Non-limiting examples of suitable nozzles include nozzles commercially available from Spray Systems, Incorporated of Pomona, Calif. under the Model 40 Nos.: 850, 1050, 1250, 1450 and 1650. Another suitable example of a spray head or nozzle is a pressure swirl atomizing nozzle made by Seaquist Dispensing of Cary, Ill. under the Model No. DU3813.

Discharge nozzles can act as a fluid atomizing nozzle, using either a pressurized spray, or a dual fluid nozzle using air assist. Pressurized spray nozzles have an advantage of not requiring high pressure air to assist atomization of the treatment fluid. Special nozzle designs can be employed as well, for example utilizing a high voltage power supply to act as an electrostatic spray nozzle.

Suitable spray heads can be solitary nozzles or a compound nozzle containing more than one nozzle. In one non-limiting embodiment there are 4 spray heads housed within a side protrusion on each side of the device with each spray head comprising 4 individual spray nozzles that are mounted in a dome shaped housing. Nozzle design typically will be chosen in conjunction with the shell design. If no side protrusion or a thin side protrusion is desired, a nozzle providing a wider angle of spray is typically used to get broad coverage where there is a short distance to the garments to be treated. A wider protrusion distance can facilitate a nozzle with a slightly narrower angle of spray to achieve acceptable coverage.

Nozzle flow rates can vary depending on the number of nozzles utilized. Typically the nozzle flow rate times the number of nozzles times the spray time will produce the desired amount of benefit composition to be applied. In a preferred mode the total spray time is less than about 200 seconds, more preferably less than about 100 seconds and even more preferably less than about 10 seconds. In one non-limiting embodiment where there are a total of 8 compound nozzles of 4 individual nozzles each, the spray time utilizing a small pump and pressure swirl nozzles, is about 2 seconds with a total benefit composition sprayed of up to about 10 grams, alternatively up to about 25 grams, alternatively up to about 50 grams, alternatively up to about 100 grams. Those of skill in the art will understand that by increasing the number of spray nozzles in the device, the total device flow rate can be increased, for example one spray nozzle can provide an increase of about 1 gram per second. In addition to the spray heads, the device can also comprise one or more ultrasonic nebulizers, such as those known in the art Optionally, the benefit composition may be heated prior to spraying. Pre-heating the benefit composition prior to spraying may be accomplished by any heating element such as a heating wire or coil, an infrared lamp, microwave heating, radiative heating or heating-means known to one of skill in the art.

Figure 3:
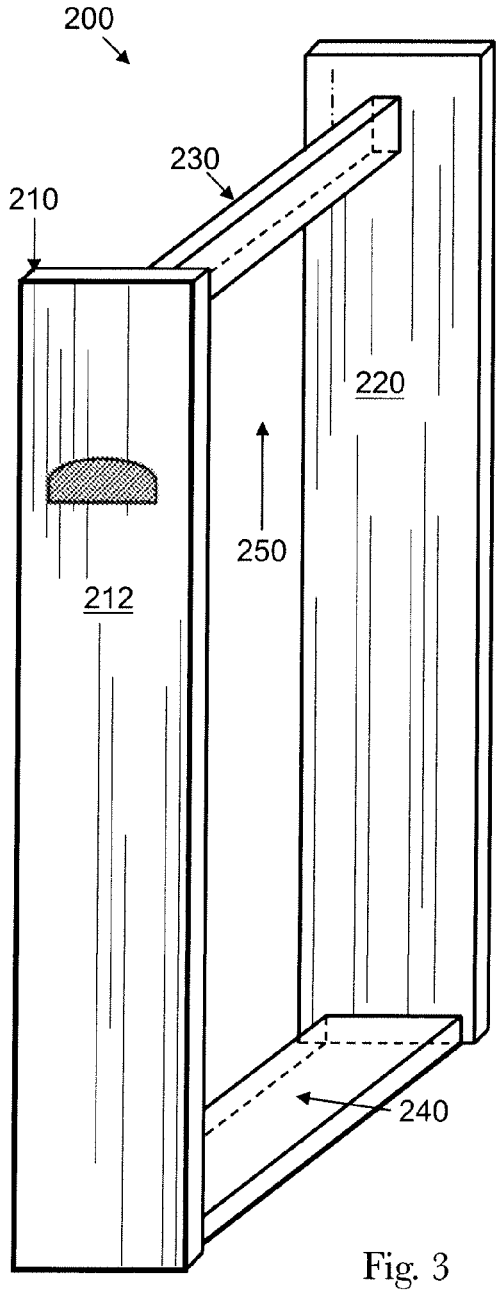
FIG. 3 is a perspective view of extractable drawer which is suitable for use any shell disclosed herein, to form a device in accordance with at least one embodiment of the present invention.

FIG. 3 is a perspective view of extractable drawer 200 for use with a device in accordance with at least one embodiment of the present invention. The extractable drawer comprises a supporting member 230 such as in the form of a rod, pole or beam, attached to both the drawer face 210 and the optional rear face 220. In one non-limiting embodiment, the extractable drawer comprises a single hanging member, in another non-limiting embodiment, multiple supporting members are provided, such as in the form of multiple supporting members. In another non-limiting embodiment, the device further comprises one or more fabric hanging members supported by the supporting member. The fabric hanging members may be removably attached to the supporting member by a hook, snap on fitment, or other suitable mechanism to allow the fabric hanging member to be supported on the supporting member while positioning the fabrics within the receiving region. In another non-limiting embodiment, the one or more fabric hanging members are permanently attached to the supporting member. In another non-limiting embodiment, the one or more fabric hanging members are hingedly attached to the supporting member.

As explained herein, the optional rear face can form a generally snug fit with the interior dimensions of the shell such that a user cannot access any components behind the rear face when the extractable drawer is fully extended in an open position. Those of skill in the art will understand that the rear face should not occupy the exact internal dimensions of the shell where wires, tubes, hoses, dispensing heads, vents, or other internal elements are required to run within the shell alongside the side walls or in the back of the shell. Further, where the device comprises one or more side protrusions, the side protrusions would also extend laterally beyond the dimensions of the rear face such that any dispensing heads contained within the side protrusion are not unduly contacted by the moving rear face. In one non-limiting embodiment, where the back of the shell comprises one or more of the vents of the venting system, the rear face can be operably designed to include apertures to allow air passing through the vents to pass into the receiving region of the extractable drawer. Further, the extractable drawer comprises a base 240. The base can have the same width as the drawer face or a smaller width. In one non-limiting embodiment, the base comprises a hole to allow exposure to any heating element provided below the extractable drawer, and/or a channel to facilitate heated air flow either by natural or forced draft convection.

Figure 4:
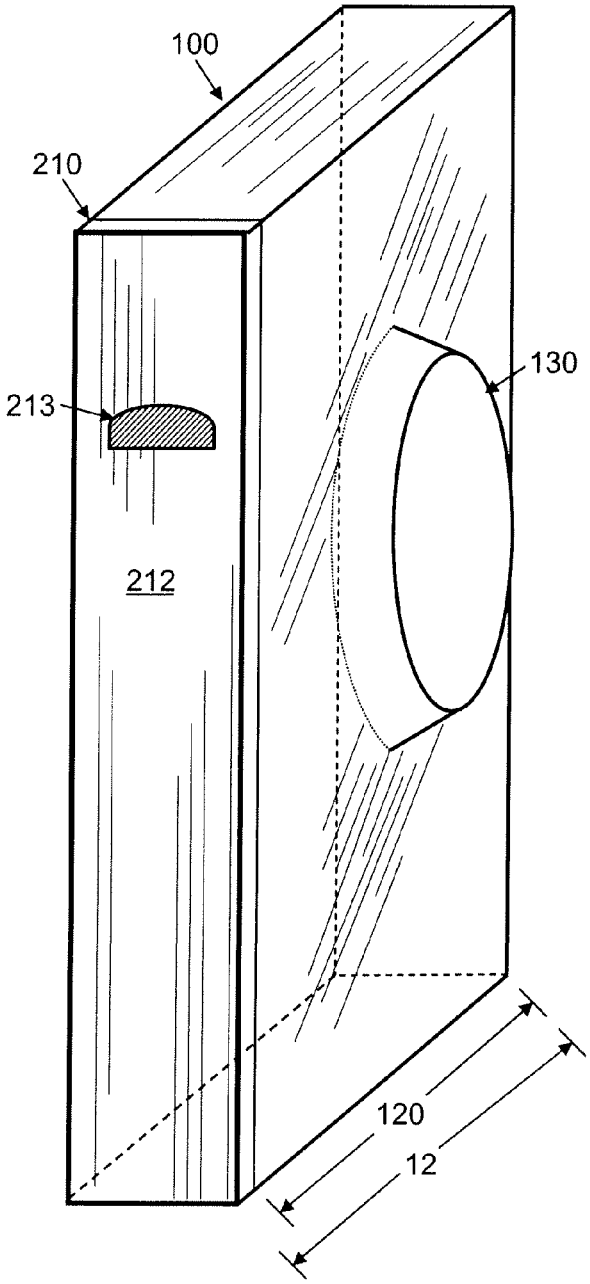
FIG. 4 is a perspective view of a device in accordance with at least one embodiment of the present invention.
Figure 6:
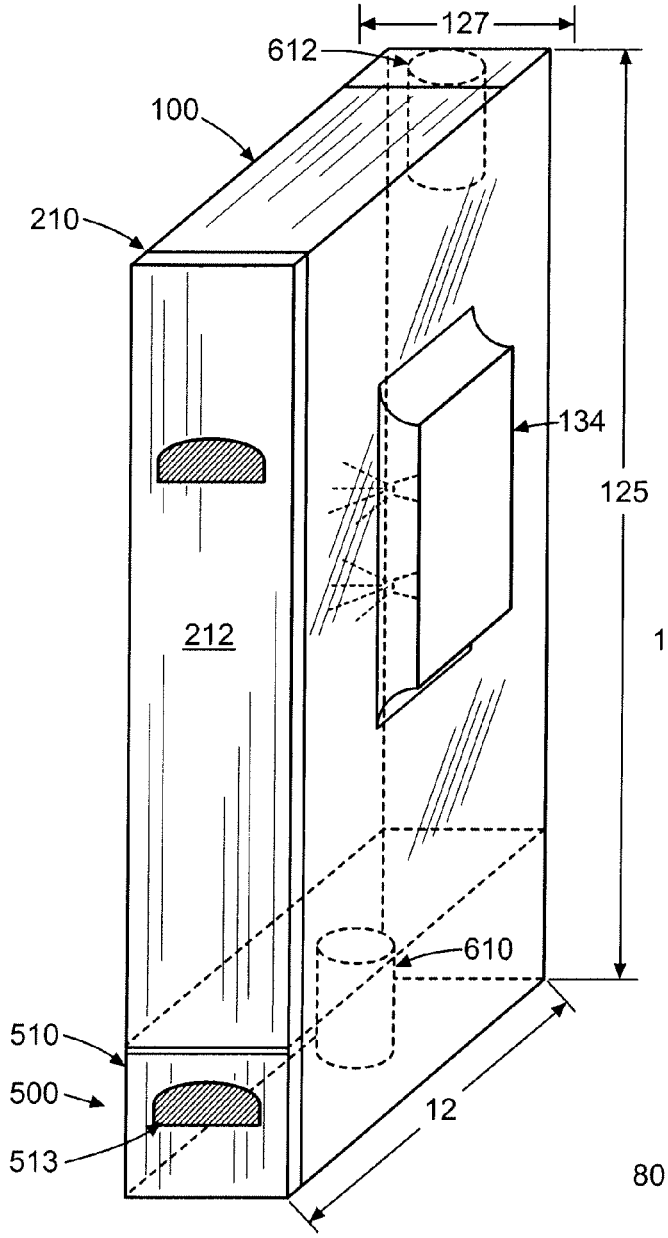
FIG. 6 is a perspective view of a device in accordance with at least one embodiment of the present invention.

FIG. 4 is a perspective view of a device in accordance with at least one non-limiting embodiment of the present invention. In this embodiment, the side protrusions 130 are shown having an arcoidal shape. Suitable shapes for the side protrusions include any prism shape, such as a rectangle, square, or other polygon (as shown in FIG. 6); or an arcoidal shape, such as a circle, oval, or ellipse. FIG. 4 is shown to have a device depth 12 which is the depth of the device in a closed position. As shown in this embodiment, the device depth can be the sum of the depth of the drawer face and the shell. In another non-limiting embodiment, where the drawer face 210 of the extractable drawer rests flush to the rest of the shell, the device depth is generally equal to the shell depth 120 (unless the outer surface of the drawer face further comprises any elements which extend outwards such as a drawer handle 213.)

Figure 5:
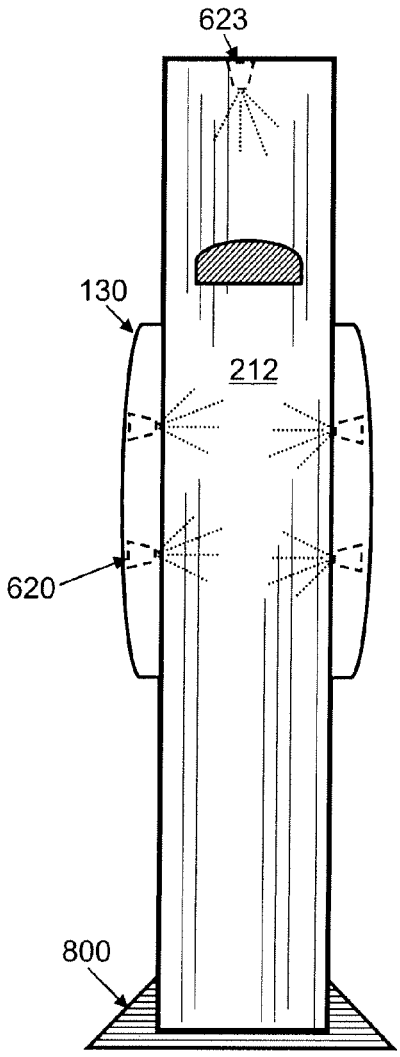
FIG. 5 is a frontal view of a device in accordance with at least one embodiment of the present invention.

FIG. 5 is a frontal view of a device in accordance with at least one non-limiting embodiment of the present invention. The device of FIG. 5 is similar to the device of FIG. 4 except that FIG. 5 further comprises a base stand 800. In embodiments comprising a base stand, the footprint width of the device is the larger of either the greatest width of the drawer face or shell, or the greatest width of the base stand. In this embodiment, the footprint width would be measured as the greatest width of the base stand.

FIG. 6 is a perspective view of a device in accordance with at least one non-limiting embodiment of the present invention. FIG. 6 shows a side protrusion having a rectangular or quadrilateral shape such as a squared or rectangular prism shape 134. FIG. 6 further comprises a second extractable drawer 500 comprising a second drawer face 510.

In one non-limiting embodiment, the extractable drawer is recessed into the interior of the shell. A hinged outer shell door can be provided to further enclose the extractable drawer within the shell. Optionally, this outer shell door can include an aperture where the knob or handle of the extractable drawer is exposed such that a user can pull the knob or handle and in one single motion hingedly open the outer shell door and extract the extractable drawer. In one non-limiting embodiment, the knob or handle protrudes out of the aperture in the outer shell door.

The device of the present invention preferably contains a source of a fabric treatment composition. In one non-limiting embodiment, the source of fabric treatment composition comprises a reservoir 610 positioned in the second extractable drawer 500 or a reservoir 612 positioned in the upper portion of the shell. Where the reservoir is positioned in the second extractable drawer, the reservoir can be accessed by pulling out the second extractable drawer. Where the reservoir is positioned in the shell forming the upper extractable drawer, an opening in the shell can be provided to allow access to the reservoir. The reservoir for a fabric treatment composition is operably connected to the one or more dispensing heads provided within the device, wherein the one or more spray heads are oriented to dispense the fabric treatment composition towards the receiving region. Importantly, the reservoir can be a refillable or replaceable reservoir.

In another non-limiting embodiment, the source of the fabric treatment composition comprises: a reservoir for a fabric treatment composition, operably connected to a plurality of dispensing heads provided within the device; a detached spray member; a fluid transport member operably connected to a building piping system; and a combination thereof. Suitable detached spray members include known hand spray products, such as FEBREZE® fabric spray, DOWNY® Wrinkle Release sprayers or any other commercially available spray apparatus, such as starch sprays or bottled perfume sprays, or aerosol can products, such as FEBREZE® Air Affects. Suitable detached spray member sizes include 12 oz. containers and 27 oz. containers. The detached spray member can be a bottle which can be provided separate from the device or can be removably attached to the device such as in a bottle stand. In one non-limiting embodiment, where the user desires just to wet the fabric with water, the source of the fabric treatment composition can be provided from another device such as a laundry machine or a faucet in the home. Suitable non-limiting sources of fabric treatment compositions include fluid dispensing systems disclosed in U.S. Publication 2010/0071777 published on Mar. 25, 2010 in the name of Smith et al and U.S. Application No. 61/138,539 to Smith et al, filed Dec. 18, 2008.

Figure 7:
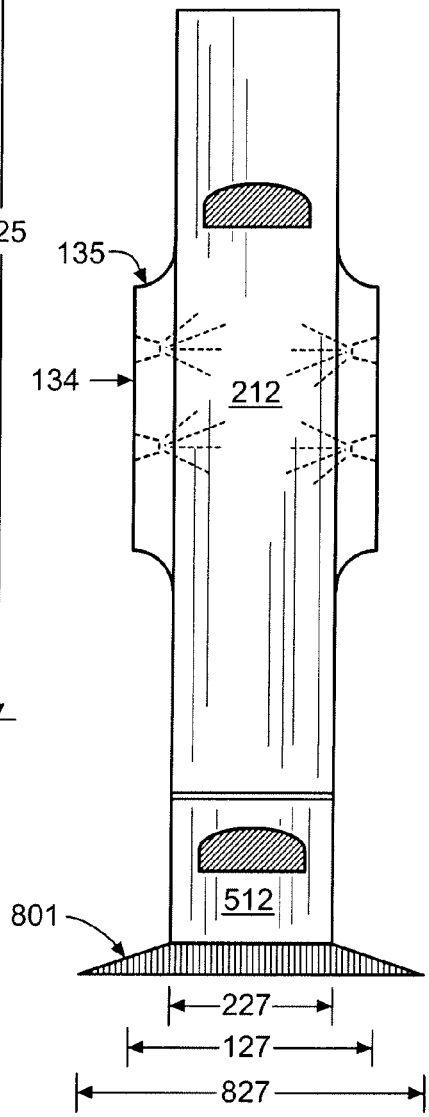
FIG. 7 is a frontal view of a device in accordance with at least one embodiment of the present invention.

FIG. 7 is a frontal view of a device in accordance with at least one embodiment of the present invention. This device is similar to the embodiment shown in FIG. 6, however the side protrusions are shown having a concave curved interface 135 between the side protrusion 134 and the side wall. Further, FIG. 7 is supported atop an optional base stand 801, the optional base stand creating a footprint width 827 which is greater than the drawer face width 227. The optional base stand provides increased stability against overturning especially in light of the footprint aspect ratio. In this embodiment, the greatest lateral width of the device is the width of the optional base stand 827 which is shown as being greater in width than the width of the portion of the shell forming the side extensions. Where the optional base stand is removed or not provided, the greatest lateral width would be the shell width 127.

Figure 8:
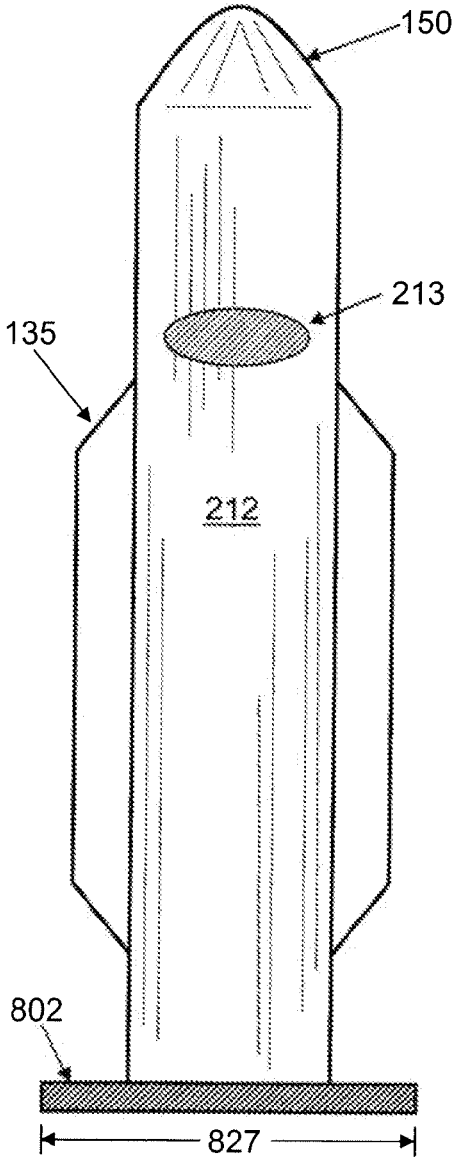
FIG. 8 is a frontal view of a device in accordance with at least one embodiment of the present invention.

FIG. 8 is a frontal view of a device in accordance with at least one no-limiting embodiment of the present invention. FIG. 8 comprises a rounded top 150. In one non-limiting embodiment, the rounded top comprises a surface which is not perfectly smooth and can be used to support a fabric laid thereon. By increasing the coefficient of friction of the rounded top, fabrics can be draped atop the machine. In one non-limiting embodiment, the static coefficient of friction of the top (rounded as shown in FIG. 8 or flat as shown in FIGS. 1-7) is greater than about 0.10 relative to common fabrics like viscose, cotton, and nylon. In one non-limiting embodiment, the top of the device has a non-smooth finish, for example a corrugated finish, a textured finish (resembling a course sand paper), or has an rough or gripping surface coating such as a rubber or silicone coating. Further, FIG. 8 shows an embodiment, wherein the device is supported on a flat base stand 802, having a footprint width of 827. Additionally, the optional handle 213 can have any shape suitable for gripping and pulling. In one non-limiting embodiment, the element shown in 213 can be a button a user could push to release and/or at least partially eject the extractable drawer from the shell. This button can be a single activation trigger pulling the drawer in and turning the machine on for operation. The extractable drawer can be spring loaded such that it will automatically extend away from the shell when actuated. It is believed that by providing an extractable drawer which is connected to the hanging member, by the single motion of extending the extractable drawer, the hanging member is automatically extracted. Thus no additional step of accessing the interior of the device and/or pulling out a hanging rod is needed. Further, by automatically exposing the hanging member, there is no need for the user to touch or contact any interior contents of the device. The interior contents of the device are likely to form deposits and/or buildups of dust or any dried fabric treatment composition upon repeated use. By decreasing the amount of contact a user needs to make with the interior contents, the use of the device is simplified and becomes more hygienic and clean.

In another non-limiting embodiment, the cabinet may comprise a user interface which comprises the aggregate means by which users can interact with the appliance, including, for example, any device or computer program portion of the appliance. In various embodiments, the use interface may comprise an input, an output, or a combination thereof. The input allows the user to enter information into the appliance 10 to manipulate or control the operation of the appliance. The output allows the appliance 10 to produce effects for the benefit of the user. In various embodiments, the input and output may comprise visual, audio, and tactile devices. In one embodiment, the input may be configured as a touch keypad and the output may be configured as a display, light emitting indicator, and/or audible alarm.

In one non-limiting embodiment, the device further comprises one or more drains (not shown) to allow excess fabric treatment composition to drain out of the cabinet into an optional drain pan (not shown). The drain can be in the form of an aperture formed within the base of the extractable drawer and/or an aperture formed in the lower portions of the shell. In embodiments comprising a second extractable drawer, the drain pan can be positioned with the extractable drawer or below the second extractable drawer such that any excess fabric treatment composition which reaches the drain pan can evaporate similar to a drain pan in a conventional refrigerator or freezer.

Figure 9:
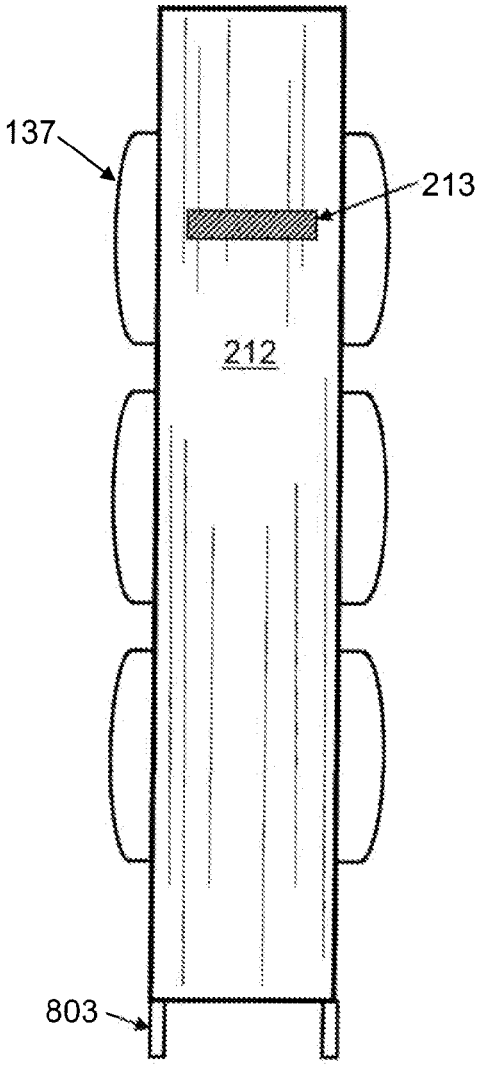
FIG. 9 is a frontal view of a device in accordance with at least one embodiment of the present invention.

FIG. 9 is a frontal view of a device in accordance with at least one non-limiting embodiment of the present invention. As shown in FIG. 9, the side walls of the shell can form a plurality of side protrusions 137. Each of the protrusions preferably contains at least one dispensing head. By providing side protrusions throughout the height of the device, the dispensing heads can efficiently and quickly wet the entire fabric contained within the receiving region of the extractable drawer, on both sides of the fabric. Further, FIG. 9 shows an embodiment wherein the device comprises a base stand 803 which can be wheels or sleds to allow for easy movement and portability of the device.

FIG. 10 shows a frontal view of a device in accordance with the present invention wherein the device comprises an extractable drawer 200 which opens by extending the drawer in a vertical or upward direction away from the shell 100. Suitable methods to extend the drawer away from the shell (or extract the drawer upwards) include spring loaded members provided within the device or chain driven or leveled mechanisms which can allow for automatic opening. In one embodiment, the extractable drawer is pulled upwards manually. As shown in this figure, extractable drawer 200 comprises a drawer face 210 and has a greatest lateral width of the drawer face of the extractable drawer 227. The device in this embodiment further comprises a greatest lateral width device of 127.

Figure 11:
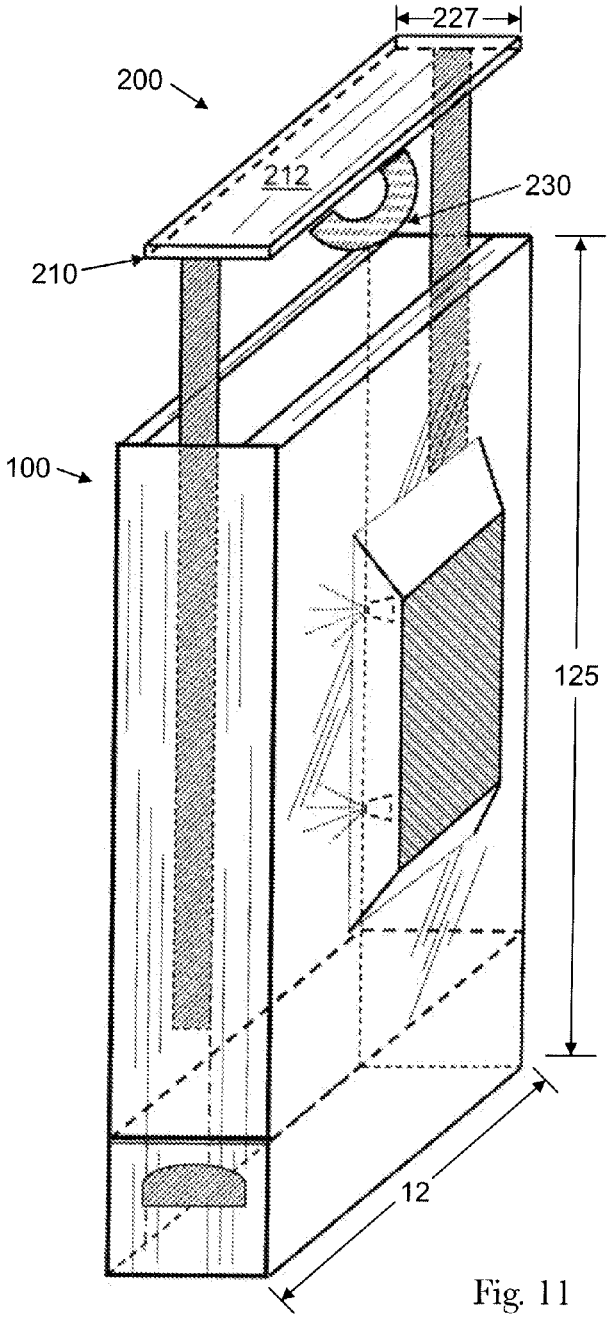
FIG. 11 is a perspective view of a device in accordance with at least one embodiment of the present invention wherein the extractable drawer extends out vertically like in FIG. 10.

FIG. 11 shows a perspective view of a device which also comprises an extractable drawer 200 which opens by extending the drawer in a vertical or upward direction away from the shell 100. Expandable drawer 200 comprises a drawer face 210 having an outer surface 212. As shown in this embodiment, extractable drawer 200 comprises a supporting member 230. Where fabrics are hung off the supporting member in the receiving region, the fabrics will be transported into the interior of the device when the extractable drawer is closed. The device further comprises a depth 12 and a height 125.

Additional optional elements include but are not limited to: one or more visible indicia provided on the exterior of the device to communicate the status of the device during operation; a sound indicator to communicate the status of the device during operation. In one non-limiting embodiment, the visible indicia comprises a countdown timer, a red/yellow/green status light system, blinking lights which can blink at different rates depending on the status of the operation, or any other light which is conventionally used with home appliances or devices. In another embodiment, the sound indicator wherein the sound indicator is operably connected to a controller so the sound indicia can change depending on the stage; preferably below 70 dB.

In one embodiment, while the device is in operation, the level of noise generated by the device during operation is less than 50 decibels at about 3150 Hz frequency, alternatively at about 4,000 Hz frequency, and alternatively at about 5,000 Hz frequency. Without intending to be bound by theory, it is believed that this level of noise is sufficiently quiet so that it does not disturb any persons or pets which may be sleeping or resting during operation of the device. This has been found to be particularly important when the device is used in a bedroom or in a closet adjacent to or connected to a bedroom. It is believed that a human is typically sensitive to noises across the audible spectrum of 20 Hz to 20 kHz.

The device may be powered by a power source including but not limited to: a solar power member; plug in AC or DC power source; a battery; fuel cell, latent heat accumulator, and combinations thereof.

Suitable Fabric Hanging Members

Fabrics can be placed in the receiving region of the fabric treatment device by any appropriate method known in the art. In one non-limiting embodiment, one or more fabrics are hung on one or more fabric hanging members. The fabric hanging members are removably or fixedly attached to the suspending member. In one non-limiting embodiment, the suspending member is in the form of one or more bars, poles, ropes and so forth, which can be attached to the front face and/or rear face of the extractable drawer. (See e.g. FIG. 1 and FIG. 3.) In another non-limiting embodiment, the suspending member extends from the drawer face of the extractable drawer. (See e.g. FIG. 10.) In one non-limiting embodiment, the suspending member suspends more than one fabric hanging members (such as conventional clothing hangers or any other hangers disclosed below). Any suitable fabric hanging member can be used in accordance with the present invention. The fabric hanger member may be made of a material which is not susceptible to forming rust or melting or deforming within the device while in operation. Non-limiting examples of suitable fabric hanging members are described in EP Pat. Nos. 812556, 670135 and 683999; DE 29713157; U.S. Pat. Nos. 7,328,822, 6,964,360, 6,817,497, 5,511,701, 5,085,358 and 5,664,710; US Publication Nos. 2008/00616, 2005/0023310; and JP 110572999.

In addition to providing a fabric hanging member within the device, in one embodiment, the device further comprises a method to apply tension to the fabrics within the cabinet such that wrinkles are reduced during operation of the device. The fabrics hung within the receiving region of the present device can also be weighted or stretched such that the fabric is under tension, to improve wrinkle reduction. Tensioning systems such as hanging weights and stretching devices are well known to those skilled in the art. See e.g. EP Pat. No. 587173; DE Pat. No. 4435672; and U.S. Pat. No. 5,344,054. Preferably, the fabrics are tensioned after placing them into the container and before starting the process or at the start of the process. This stretching or so-called tensioning of the fabric helps the relaxation of wrinkles during the process and provides a restoring force to the fabric to reestablish an unwrinkled orientation as the device operates.

Preferred stretching systems include weighted as well as lightweight compactable or retractable stretching systems, wherein the system comprises a tensioning device like a spring. The latter systems have the benefit of not adding extra weight to the cleaning and refreshing apparatus, along with the possibility of adjusting tensioning force and direction as required. These systems may be mounted inside the container at its bottom. One non-limiting example of such a system is a roller blind that is conventionally used as a sun filter for cars and is commercially available from Halfords. This system is a roller blind which can be extended or compacted by means of a roll-up spring mechanism. Only slight modification of this system is needed to adapt it to the tensioning of fabric. One preferred adaptation involves attaching the housing of this system at the bottom of the apparatus and providing one or more clamps at the other side so that the clamping and thus the stretching or tensioning of the fabric in the apparatus is obtained. The tension of the spring can also be adjusted to the desired stretching force for a given fabric. The size of the clamp can vary so that more than one clamp is attached to this system. Still, another variation involves having only one clamp which run along or partly along the blind tensioning system located opposite the housing of the system.

In one non-limiting embodiment, the hanging member and optional tensioning system are movable within the shell. By moving the hanging member and optional tensioning system, the receiving region with any fabrics contained therein can be moved from one side of the device to another, such as in a lateral direction. Moving the fabrics laterally allows for increased distance from the dispensing heads positioned on the interior of the opposite side wall and/or optional protrusion(s). Thus, in one non-limiting embodiment, the fabrics are moved to one side of the interior of the device while the distribution of the fabric treatment composition is coordinated to emit from the opposite side of the device, for example wetting the front of the fabrics. Correspondingly, the fabrics can be moved to the other side of the device such that the other set of dispensing heads are triggered to wet the other side of the fabrics, such as the back of the fabrics. This increases the lateral distance between the fabric surface being wetted and the dispensing heads allowing for better distribution. The moveable hanging member can be achieved by any mechanical system suitable for use, such as a chain driven system or a gear driven system.

Fabric Treatment Composition

Any conventional liquid and/or fluid fabric treatment composition can be used as a fabric treatment composition without deviating from the present invention. Suitable fabric treatment compositions include any liquid or fluid composition which reduces and/or removes wrinkles, malodors, and/or delivers any other desirable fabric treatment benefits. Additional suitable fabric treatment compositions include perfumes and fragrances which can impart desirable odors upon the fabrics and or into the ambient air where the device is stored. Water, including purified water, tap water and the like are also suitable fabric treatment compositions.

Although the present device is preferably used for refreshing a fabric or garment, such as by reducing malodors and/or wrinkles, it is possible to use a composition which can be stain repellent and/or also assist in the removal of stains, soil, discolorations and/or other undesirable affects from the wearing and use of the fabrics.

In one non-limiting embodiment, the fabric treatment composition comprises water and optionally a member selected from the group consisting of surfactants, perfumes, preservatives, bleaches, auxiliary cleaning agents, shrinkage reducing compositions, organic solvents, antimicrobial agents, and mixtures thereof. The fabric treatment composition may include both volatile and non-volatile ingredients. Non-limiting examples of suitable organic solvents are glycol ethers, specifically, methoxy propoxy propanol, ethoxy propoxy propanol, propoxy propoxy propanol, butoxy propoxy propanol, butoxy propanol, ethanol, isopropanol, wrinkle removing agents, in-wear anti-wrinkling agents, semi-durable press agents, odor absorbing agents, volatile silicones and mixtures thereof. Non-limiting examples of fabric shrinkage reducing compositions that are suitable for use include ethylene glycol, all isomers of propanediol, butanediol, pentanediol, hexanediol and mixtures thereof. In one non-limiting embodiment, the fabric shrinkage reducing compositions are selected from the group consisting of neopentyl glycol, polyethylene glycol, 1,2-propanediol, 1,3-butanediol, 1-octanol and mixtures thereof. Non-limiting examples of suitable surfactants include a nonionic surfactant, such as an ethoxylated alcohol or ethoxylated alkyl phenol, and is present at up to about 2%, by weight of the fabric treatment composition. Non-limiting examples of suitable auxiliary cleaning agents include cyclodextrins and dewrinkling agents, such as silicone containing compounds. Non-limiting examples of suitable anti-wrinkling agents include volatile silicones, some of which can be purchased from the Dow Corning Corporation. One such volatile silicone is D5 cyclomethicone decamethyl cyclopenta siloxane. Typical fabric treatment compositions herein can comprise at least about 80%, by weight, water, alternatively at least about 90%, or alternatively at least about 95% water. Non-limiting examples of suitable fabric treatment compositions are provided in U.S. Pat. Nos. 6,726,186 to Gaaloul et al.

Another suitable fabric treatment composition is the polymer composition having specified pH for improved dispensing and improved stability of wrinkle reducing composition disclosed in U.S. Pat. No. 6,491,840 and the aqueous wrinkle control composition disclosed in U.S. Pat. No. 6,495,058 both issued in the name of Frankenbach et al.

In yet another non-limiting embodiment, suitable fabric treatment compositions are disclosed in U.S. Publication No. 2009/0038083 published on Feb. 12, 2009 in the name of Roselle et al. For example, one suitable fabric treatment composition comprises a water soluble quaternary ammonium surfactant. Typically the minimum levels of the water soluble quaternary agent included in the composition are at least about 0.01%, alternatively at least about 0.05%, or alternatively at least about 0.1%, while typical maximum levels of water soluble quaternary agent are up to about 20%, alternatively less than about 10%, alternatively less than about 3% and generally in the range of about 0.2% to about 1.0%. A substantially water insoluble oil component or oil mix may be included wherein the oil components may have a clogP of >1. Typically the minimum levels of the oil component included in the composition are at least about 0.001%, alternatively at least about 0.005%, or alternatively at least about 0.01% while typical maximum levels of oil components are up to about 5.0%, alternatively less than about 3%, and generally in the range of about 0.05% to about 1%. Optional ingredients may also be included while the balance of the composition is water.

Method of Treating a Fabric

A method of treating a fabric comprises placing a fabric into the receiving region of the device; depositing a fabric treatment composition upon at least a portion of the fabric; actuating the heating element; and venting the device. In one non-limiting embodiment, the step of depositing the fabric treatment composition comprises dispensing the fabric treatment composition onto the fabrics, such as by spraying, vaporizing, or misting. In one non-limiting embodiment, the step of actuating the heating element further comprises a step of heating the air within the device to at least about 80° C., alternatively to at least about 70° C., alternatively to at least about 50° C. Without intending to be bound by theory, it is believed that this application of heat not only helps dry the fabric but also may have odor removal and/or microbial control benefits. Further, where a fabric treatment composition is used which includes antimicrobial agents, the addition of heat may give surprising odor control and anti-microbial benefits to the fabric. In another non-limiting embodiment, the method of treating the fabric is completed within about 18 minutes, alternatively within about 13 minutes, alternatively within about 10 minutes. In one non-limiting embodiment, the method further comprises pressing a single button to turn on the device.

Flexural Rigidity Test Method

The following describes methodology for gathering flexural rigidity measures on fabric samples in accordance with ASTM Method D1388-08 Standard Test Method for Stiffness of Fabrics; Option A. Cantilever Test.

Step 1. Stripping of New Fabric Swatches:

Stripping of all new fabrics should be done to remove any coatings, finishes, etc applied at the textile mill. Upon receipt, the below mentioned test fabrics should be stripped and dried according to the following:

Equipment & Materials

Acquire 2 lots of the following standard fabric, such as from TestFabrics.com, West Pittston, Pa.

Style 493 Cotton Sheeting 151 gm/m$^2$

Fabric should be cut to 30 cm×30 cm size and serged to prevent shredding during wash Kenmore Elite top loading washer—model # SM9711033A (or similar)

Load size—Largest load size option

Agitation/spin speed—Fast/Fast or Heavy Duty Speed

Wash cycle time—12 minute

Wash and rinse temperature—49° C. (120° F.)

AATCC Detergent—1993 Standard Reference Detergent nil-P and nil-Brightener

AATCC Ballast (to achieve target load size) comprised of an equal distribution of 100% cotton white pillowcases, towels, T-shirts Total load weight—6 lbs or 2722 grams Kenmore Elite clothes dryer—model # 110.62062103 (or similar)

| Wash Cycle # | Wash & Rinse Water Temp | Wash & Rinse Water Hardness (gPg) | Detergent |
|---|---|---|---|
| 1 | 49° C. (120° F.) | 0 | AATCC - 66 grams |
| 2 | 49° C. (120° F.) | 0 | AATCC - 66 grams |
| 3 | 49° C. (120° F.) | 0 | Nil-detergent (clear wash/rinse) |
| 4 | 49° C. (120° F.) | 0 | Nil-detergent (clear wash/rinse) |

When wash cycles are completed, place ballast and test fabrics in dryer and dry on highest heat setting for 50 minutes. Immediately remove test fabrics from dryer and lay flat until ready for the following preparation step.

Step 2. Fabric Test Strip Preparation:

Equipment & Materials

Stripped Fabric Swatches

Style 493 Cotton Sheeting 151 gm/m$^2$

Permanent Black Fine-Tipped Marking Pen (Sharpie, etc)

Sample Cutting & Labeling

Each fabric lot is considered 1 sampling unit. From each sampling unit, take a total of four specimens from the machine direction across 4 different pieces of fabric. Cut these fabric specimens to 25 mm×235 mm. The actual specimen length designated in method D1388-08 for the Shirley Fabric Stiffness Tester is 200 mm. Cutting the fabric test strips to 235 mm provides the tester with additional strip length needed for securing the fabric test strip inside the garment freshening device. After treatment the 'testable' strip length (the portion that will be measured using the Shirley device) will be cut from the treated strip, and the extra strip length will be discarded. This ensures that clean edges, free of deformation from the clips, are presented for testing with the Shirley device.

Using a permanent black fine-tipped pen, mark a dotted lines at 17.5 mm in from both the north and south ends of the fabric test strip. This will identify the final 'testable' strip length of 200 mm. Immediately following the completion of the treatment, cut along these lines and remove the test fabric test strip from the garment freshening device.

Step 3. Evaluating the Crispness of Control Samples:

The following describes how to measure the overhang length and calculate the bending length and flexural rigidity (ujoule/m) of control/untreated fabric samples. This data will be used to calculate the % increase in flexural rigidity from treatment in a fabric freshening device.

Equipment & Materials

SDL Atlas Textile Testing Solutions—Shirley Fabric Stiffness Tester Model M003B

Fabric Test Strips (Style 493)

Temperature/Humidity controlled environment 21+/−1° C. (70+/−2° F.) and 65+/−2% relative humidity See ASTM method D 1388-08 Standard Test Method for Stiffness of Fabrics, beginning with Step # 8 (Preparation of Test Apparatus and Calibration), and continuing through the completion of Step # 12 (Report).

Step 4. Evaluating the Flexural Rigidity of Treated Samples:

This following describes how to measure the overhang length and calculate the bending length and flexural rigidity (ujoule/m) of fabric samples treated in a garment freshening device. This data will be used to calculate the % increase in flexural rigidity delivered by the garment freshening device.

Equipment & Materials

SDL Atlas Textile Testing Solutions—Shirley Fabric Stiffness Tester Model M003B

Garment Freshening Device

Fabric Swatches

Style 493 Cotton Sheeting 151 gm/m$^2$

Ballast Garment—Lands' End 100% Cotton Light Blue Supima Pinpoint Oxford Shirt, size 16×33. If this exact garment can not be obtained, use 100% cotton light blue Pinpoint Oxford shirt of similar size having basis weight of 0.0144 grams/cm$^2$+/−5% (0.0137-0.0151 grams/cm$^2$)

Binder Clips—Staples® brand, medium binder clips, 32 mm

Cable Ties—THG The Hillman Group, part # 848646

Washers—Hillman flat stainless washers, combination of #10, #12, and 10×1 sizes

Temperature/Humidity controlled environment 21+/−1° C. (70+/−2° F.) and 65+/−2% relative humidity Adhesive-backed craft foam or felt (Such as Creatology™ Fun Foam, Stick-IT Felt)

See ASTM method D 1388-08 Standard Test Method for Stiffness of Fabrics, beginning with Step # 8 (Preparation of Test Apparatus and Calibration), and continuing through the completion of Step # 9 (Conditioning). At this point, the fabric test strips are ready to be treated.

Load ballast shirt in accordance with instructions provided by the garment freshening device manufacturer.

Mounting of the Fabric Test Strips in the Garment Freshening Device—Without Tensioning Obtain one Staples® brand medium 32 mm binder clip. To ensure the fabric test strip will remain held in place between the jaws of the binder clip, grip pads (made of foam/felt material) should be placed on both inside grips of the binder clip. Cut two portions of Creatology™ sticky-back foam, or Stick-IT Felt, each 32 mm×10 mm, and secure them in place on the inside of the binder clip jaws. Attach the binder clip to the north end of the fabric test strip and secure it to the ballast garment by looping the back silver handle around the shirt button that is closest to 17 cm below the top collar button. Allow the south end of the fabric test strip to hang freely.

Mounting of the Fabric Test Strips in the Garment Freshening Device—With Tensioning Test Strip Tensioning Assembly—To simulate the tensioning forces of a representative tensioning device, a tension of 102 grams per inch is utilized, so for a fabric test strip width of 25 mm, a weight of 100 grams is needed. Obtain two Staples® brand medium 32 mm binder clips. To ensure the fabric test strip will remain held in place between the jaws of the binder clips, grip pads (made of foam/felt material) should be placed on both inside grips of the binder clips. For each clip, cut two portions of Creatology™ sticky-back foam, or Stick-IT Felt, each 32 mm×10 mm, and secure them in place on the inside of the binder clip jaws. Secure the north end of the fabric test strip to the ballast garment by attaching a binder clip and looping the back silver handle around the shirt button that is closest to 17 cm below the top collar button. Take the second clip, ensuring that the silver handles are pointed away from the pincher, and thread a single cable tie through both of the handles. Thread enough washers onto the cable tie to deliver a total weight of 100 grams; that is, the total weight of the binder clip, grip pads, cable tie and washers should be 100 grams. Thread the narrow end of the cable tie through the opening in the opposite end to secure the tie. Attach this clip to the south end of the fabric test strip.

Completing a Treatment Cycle Using Garment Freshening Device

The garment freshening device must be located and operated inside a temperature/humidity controlled environment with the following specifications: 21+/−1° C. (70+/−2° F.) and 65+/−2% relative humidity. This is to ensure that fabric test strips are always exposed to controlled conditions when removed from the garment freshening device and measured with the Shirley Fabric Stiffness Tester.

Designated Time Points for Testing in Garment Freshening Devices:

| | |
|---|---|
| Full Cycle | In accordance with manufacturer recommendation |
| 18 Minute Cycle | Initiate treatment cycle, allow to run for exactly 18 total minutes, then terminate, immediately open the device and proceed as outlined below |
| 13 Minute Cycle | Initiate treatment cycle, allow to run for exactly 13 total minutes, then terminate, immediately open the device and proceed as outlined below |
| 10 Minute Cycle | Initiate treatment cycle, allow to run for exactly 10 total minutes, then terminate, immediately open the device and proceed as outlined below |

Initiate Treatment Cycle in Accordance with Instructions Provided by the Garment Freshening Device Manufacturer.

When the device cycle is complete or terminated, immediately open the garment freshening device to access the test strip. Grab the south end clip/weight assembly (if test strip is under tension) and using scissors, cut along the south end dotted line. If tension was not used, still cut along the south end dotted line to remove excess strip length. Carefully grip the north end binder clip and un-loop it from the shirt button, being careful to keep the strip in a vertical position and perpendicular to the floor. Do not bend or curl the strip while removing it from the device or placing it onto the horizontal platform of the Shirley tester. Once the test strip has been laid on the Shirley tester platform, cut and remove the north end binder clip along the north dotted line, keeping the strip flat along the platform. See ASTM method D-1388-08 and begin with step # 10 (Procedure) and continue through the completion of Step # 12 (Report). The measuring step using the Shirley tester is initiated within 30 seconds of removal from the garment freshening device and the four total measures on the fabric test strip (face and back of both ends) are completed within 5 minutes of removal from the garment freshening device.

Step 5. Calculating % Increase in Flexural Rigidity for Treated Samples:

Where G=Flexural Rigidity in ujoule/m $$\%\ G\ \text{Increase}=(G\ \text{of treated sample}-G\ \text{of control sample})/G\ \text{of control sample}\times 100$$

Energy Consumption:

The following Wattmeter can be used to measure the energy consumption used by a fabric treatment device, as measured in Watt hours. Electricity Watt Meter Model: Watts up?, Voltage: 120 VAC/60 HZ, from Electronic Educational Devices, Inc. of Denver, Colo. www.doubleed.com Flexural Rigidity Data:

Two sets of tests are conducted to measure the flexural rigidity achieved with a device in accordance with the present invention in accordance with the FLEXURAL RIGIDITY TEST defined above. Both tests use a 493 Fabric weighting 0.0151 grams/cm2 cut to the specifications above and tested with deionized water as the fluid. Test A was conduced with no tensioning. Test B was conducted with 102 gram/inch of tensioning. "n" represents the number of test runs.

| Test A: Treatment with DI water, without Tension | | | | Flexural Rigidity Data |
|---|---|---|---|---|
| Device | Cycle Time | Average Watt Hours | n | Avg % G increase versus Control |
| Personal Valet ® | Full Cycle ~60 min | 817 | 8 | 149% |
| | 18 min | 133 | 8 | −15% |
| Pret-a-Porte ® | Full Cycle ~40 min | 511 | 8 | 52% |
| | 18 min | 334 | 8 | 66% |
| | 13 min | 236 | 8 | 27% |
| | 10 min | 175 | 8 | 0% |
| SAMPLE DEVICE | 18 min | 364 | 8 | 179% |
| | Full Cycle 13 min | 364 | 8 | 148% |
| | 10 min | 275 | 8 | 154% |

| Test B: Treatment with DI Water and 102 gr/inch of Tension | | | | Flexural Rigidity Data |
|---|---|---|---|---|
| Device | Cycle Time | Average Watt Hours | n | Avg % G increase versus Control |
| Personal Valet ® | Full Cycle ~60 min | 817 | 8 | 231% |
| | 18 min | 133 | 8 | 26% |
| Pret-a-Porte ® | Full Cycle ~40 min | 511 | 8 | 162% |
| | 18 min | 334 | 8 | 149% |
| | 13 min | 236 | 8 | 103% |
| | 10 min | 175 | 8 | 48% |
| SAMPLE DEVICE | 18 min | 364 | 8 | 293% |
| | Full Cycle 13 min | 364 | 8 | 182% |
| | 10 min | 275 | 8 | 227% |

Pret-a-Porte ® is commercially available from Whirlpool Corporation, Benton Harbor, MI.
Personal Valet ® is commercially available from Whirlpool Corporation, Benton Harbor, MI.
Sample Device is a device made in accordance with the present invention.

FLEXURAL RIGIDITY WITHOUT TENSIONING, with no tensioning applied to the fabrics: It has been found that the present refreshing cabinet, when tested with the FLEXURAL RIGIDITY TEST defined herein, without tensioning, can provide a 10 minute flexural rigidity increase of at least about 50%, alternatively at least about 100%, alternatively at least about 150%. In one non-limiting embodiment, the refreshing cabinet can provide a 13 minute flexural rigidity increase of at least about 50%, alternatively at least about 100%, alternatively at least about 148%. In another non-limiting embodiment, the refreshing cabinet can provide an 18 minute flexural rigidity increase of at least about 100%, alternatively at least 150%. In yet another non-limiting embodiment, the refreshing cabinet can provide a full cycle flexural rigidity increase of at least about 75%, alternatively at least about 100%, when determined at the manufacturer suggested full cycle time. Preferably, when run at the full cycle, the energy consumption of the device is below about 800 watt hours, alternatively less than 500 watt hours, alternatively less than about 400 watt hours. In on preferred embodiment, the full cycle flexural rigidity increase from using the present refreshing cabinet is at least about 150%, with an energy consumption of below about 450 watt hours. It is believed that providing such a high amount of flexural rigidity increase at such a low amount of energy consumption provides an energy efficient way to prepare fabrics without the use of applied pressure and heat such as from an iron or a press. It is believed that a flexural rigidity increase of from 25 to about 50% increase would be consumer noticeable in appearance and/or fabric feel.

Further, the refreshing cabinet of the present invention provides a wrinkle improvement grade of at least about 0.1 to about 3, alternatively at least 0.5, in accordance with the WRINKLE TEST METHOD without tensioning as defined herein. Furthermore, in one non-limiting embodiment, one or more of the fabric treatment actives, such as perfume is deposited onto the fabrics.

FLEXURAL RIGIDITY WITH TENSIONING, with tensioning applied as defined above: It has been found that the present refreshing cabinet when tested with tensioning can provide a 10 minute flexural rigidity increase of at least about 100%, alternatively at least about 125%, alternatively at least about 150%, alternatively at least about 200%. In another non-limiting embodiment, the refreshing cabinet provides a 13 minute flexural rigidity increase of at least about 150%, alternatively at least about 180%. In yet another non-limiting embodiment, the refreshing cabinet provides 18 minute flexural rigidity increase of at least about 175%, alternatively at least about 200%, alternatively at least about 250%, alternatively at least about 275%. In yet another embodiment, the refreshing cabinet can provide a full cycle minute flexural rigidity increase of at least about 150%, at least about 175%, and an energy consumption of below about 800 watt hours, alternatively less than 500 watt hours, alternatively less than about 450 watt hours, or alternatively less than about 400 watt hours.

Wrinkle Test Method and Data:

The Wrinkle Test Method for evaluating the performance in a fabric treating device herein follows the AATCC Test method 124-2006 (Appearance of fabrics after repeated home laundering) using Smoothness Appearance (SA) grading by SA replica equivalents. The following set-points and/or exceptions to the method are noted here:

Test Specimens:

The test specimen is a long sleeve shirt, Lands' End 100% cotton light blue supima pinpoint oxford shirt, size 16×33 or equivalent. An equivalent shirt should be a 100% light blue pinpoint Oxford shirt of similar size having a basis weight of 0.0137-0.0151 gm/cm$^2$.

Test Specimen Preparation Procedure: Machine Washing/Machine Drying.

1. Use 17-gallons of city water at 95° F. (35° C.) wash cycle and <85° F. (29° C.) rinse cycle in a standard washing machine.
2. Add 66.0±0.1 g of AATCC standard reference detergent.
3. Add test specimens and enough ballast fabrics to make a 6.0±0.13 lb. load.
4. Use Normal or Cotton Sturdy setting on washer, and set control for 12 minutes agitation.
5. Allow washing to proceed automatically through the final spin cycle.
6. Remove the test specimens immediately after the final spin cycle and separate tangled pieces, taking care to minimize distortion.
7. Specimens may have a folded or creased appearance after removal from the washer. Such creases present after laundering should be straightened out prior to drying.
8. Place the test specimens and ballast in the tumble dryer and set the temperature control to Cotton/Sturdy for a total of 50 minutes (40 min. heat, 10 min cool-down).
9. After the dryer cycle is complete, allow specimens and ballast to remain in dryer for 18 hours.
10. Prior to initial wrinkle assessment (before treating in treatment device) the shirts are conditioned in a Temperature/Humidity controlled environment at 70±2 F and 65±2% RH for 30 minutes.
11. Initial SA grades are assessed by hanging a shirt on the viewing board and use the wrinkle replicas to guide assigning grades. The observers should mentally integrate degree and frequency of wrinkles in the specimen to determine a level of smoothness that can be identified with the SA replica number that most nearly represents that smoothness appearance level. Grades can be interpolated from the replica standards and assigned to the nearest tenth of a unit. See Evaluations below.

Treating in Fabric treatment device:

1) The shirt specimen is mounted in and processed in the fabric treatment device in accordance with the manufactures recommendations for a cotton shirt.
2) Prior to final (post treatment) wrinkle assessment, the shirts are conditioned in a Temperature/Humidity controlled environment at 70±2 F and 65±2% RH for 30 minutes.
3) Final SA grades are assessed by hanging a shirt on the viewing board and use the wrinkle replicas to guide assigning grades. The observers should mentally integrate degree and frequency of wrinkles in the specimen to determine a level of smoothness that can be identified with the SA replica number that most nearly represents that smoothness appearance level. Grades can be interpolated from the replica standards and assigned to the nearest tenth of a unit. See Evaluations below.

Evaluations:

Smoothness Appearance Method (To be used for laundry induced wrinkles, AATCC Method 124)

1. Three trained observers should rate each test specimen independently.
2. The overhead fluorescent light should be the only light source for the viewing board, and all other lights in the room should be turned off.
3. The observers are to stand directly in front of the specimen four feet (+/−1.0 in.) away from the viewing board. Normal variation in the height of the observer above and below the arbitrary five-foot eye level has no significant effect on the rating given.
4. Mount the test specimen on the viewing board. Place the most similar three-dimensional plastic replicas on each side of the test specimen to facilitate comparative rating.
5. Assign the number of the replica (to the nearest tenth) that most nearly matches the appearance of the test specimen. The observer should mentally integrate degree and frequency of wrinkles in the specimen to determine a level of smoothness that can be identified with the SA replica number that most nearly represents that smoothness appearance level.

6. An SA-5 grade is equivalent to the SA-5 replica and represents the smoothest appearance, while an SA-1 replica represents very poor appearance.
7. If dryer creases are present on any specimens to be evaluated, take care in rating the specimens. Some dryer creases can be disregarded (commonly called "reading out")
8. Average the three observation made on each test swatch/garment.
9. Report the average to the nearest tenth of a rating.
10. Repeat steps until all garment(s) have been evaluated.

2 replicate specimens (shirts) for each treatment device were tested. SA grades were assigned pre and post treatment. The difference between pre (initial) and post treatment was then calculated by subtracting the initial value from the final value.

| Treatment | Initial SA grade (avg of 6) | Final 'Post-treat SA grade (avg of 6) | Avg SA Delta (Improvement) |
|---|---|---|---|
| SAMPLE DEVICE | 1.75 | 3.50 | +1.75 |
| Personal Valet ® | 1.58 | 3.63 | +2.04 |
| Pret-A-Porte ® | 1.5 | 3.75 | +2.25 |

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the DETAILED DESCRIPTION OF THE INVENTION are, in the relevant part, incorporated herein by reference; the citation of any document is not to be construed as an admission that it is prior art with respect to the present invention. To the extent that any meaning or definition of a term or in this written document conflicts with any meaning or definition in a document incorporated by reference, the meaning or definition assigned to the term in this written document shall govern.

Except as otherwise noted, the articles "a," "an," and "the" mean "one or more." All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A refreshing cabinet comprising:

a. a shell comprising an opening wherein said shell comprises a pair of sidewalls and liquid dispensing heads positioned on said sidewalls; and b. an extractable drawer adapted to fit said opening, said extractable drawer comprising: a drawer face comprising an outer surface; a supporting member for suspending a fabric or a fabric hung upon a fabric hanging member, wherein said fabric hanging member is a hanger, wherein said drawer face and said supporting member form a receiving region adapted to operably support a fabric; a heating element contained within said shell; and an air flow path positioned to direct air through said receiving region;

c. wherein said refreshing cabinet provides a 10 minute flexural rigidity increase in said fabric of at least about 50%, in accordance with the FLEXURAL RIGIDITY TEST METHOD without tensioning, as defined herein; and d. wherein said receiving region where said fabric is placed and said liquid dispensing heads are separated by a lateral distance less than about 30 cm.

2. The refreshing cabinet of claim 1, wherein the 10 minute flexural rigidity increase in said fabric is at least about 150%.

3. The refreshing cabinet of claim 1, wherein the flexural rigidity increase in said fabric in 13 minutes is at least about 50%, in accordance with the FLEXURAL RIGIDITY TEST METHOD without tensioning, as defined herein.

4. The refreshing cabinet of claim 1, wherein the flexural rigidity increase in said fabric in 18 minutes is at least about 100%, in accordance with the FLEXURAL RIGIDITY TEST METHOD without tensioning, as defined herein.

5. The refreshing cabinet of claim 1, wherein the flexural rigidity increase after a full cycle is at least about 75%, in accordance with the FLEXURAL RIGIDITY TEST METHOD without tensioning at the manufacturer suggested full cycle time, as defined herein; and the refreshing cabinet has an energy consumption of below about 800 watt hours.

6. The refreshing cabinet of claim 5, wherein the flexural rigidity increase after a full cycle is at least about 150%, in accordance with the FLEXURAL RIGIDITY TEST METHOD without tensioning at the manufacturer suggested full cycle time, as defined herein and the refreshing cabinet has an energy consumption of below about 450 watt hours.

7. The refreshing cabinet of claim 5, wherein said refreshing cabinet provides a wrinkle improvement grade in said fabric of at least about 0.1 to about 3 in accordance with the WRINKLE TEST METHOD without tensioning as defined herein.

8. The refreshing cabinet of claim 7, wherein the wrinkle improvement grade is at least 0.5.

9. The refreshing cabinet of claim 5, wherein a perfume is deposited onto the fabric.

10. The refreshing cabinet of claim 1, wherein said liquid dispensing heads are positioned within protrusions of the sidewalls.

11. The refreshing cabinet of claim 1, wherein said fabric hanging member is removably attached to said supporting member.

12. The refreshing cabinet of claim 1, wherein said air flow path is positioned to direct air upward through said receiving region.

13. The refreshing cabinet of claim 1, wherein said dispensing heads dispense up to about 100 grams of a benefit composition per use.

14. The refreshing cabinet of claim 13, wherein said dispensing heads dispense said benefit composition in less than about 200 seconds.

15. A refreshing cabinet comprising:

a. a shell comprising an opening wherein said shell comprises a pair of sidewalls and liquid dispensing heads positioned on said sidewalls; and b. an extractable drawer adapted to fit said opening, said extractable drawer comprising: a drawer face comprising an outer surface; a supporting member for suspending a fabric or a fabric hung upon a fabric hanging member, wherein said fabric hanging member is a hanger, wherein said drawer face and said supporting member form a receiving region adapted to operably support a fabric; a heating element contained within said shell; and an air flow path positioned to direct air through said receiving region;

c. wherein said refreshing cabinet provides a 10 minute flexural rigidity increase in said fabric of at least about 100%, in accordance with the FLEXURAL RIGIDITY TEST METHOD with tensioning, as defined herein; and d. wherein said receiving region where said fabric is placed and said liquid dispensing heads are separated by a lateral distance less than about 30 cm.

16. The refreshing cabinet of claim 15, wherein the 10 minute flexural rigidity increase in said fabric is at least about 200%.

17. The refreshing cabinet of claim 15, wherein the flexural rigidity increase in said fabric in 13 minutes is at least about 150%, in accordance with the FLEXURAL RIGIDITY TEST METHOD with tensioning, as defined herein.

18. The refreshing cabinet of claim 15, wherein the flexural rigidity increase in said fabric in 18 minutes is at least about 175%, in accordance with the FLEXURAL RIGIDITY TEST METHOD with tensioning, as defined herein.

19. The refreshing cabinet of claim 15, wherein the flexural rigidity increase after a full cycle is at least about 150%, in accordance with the FLEXURAL RIGIDITY TEST METHOD with tensioning at the manufacturer suggested full cycle time, as defined herein; and the refreshing cabinet has an energy consumption of below about 800 watt hours.

20. The refreshing cabinet of claim 19, wherein the flexural rigidity increase after a full cycle is at least about 250%, in accordance with the FLEXURAL RIGIDITY TEST METHOD with tensioning at the manufacturer suggested full cycle time, as defined herein and the refreshing cabinet has an energy consumption of below about 450 watt hours.

21. The refreshing cabinet of claim 20, wherein the refreshing cabinet provides a wrinkle improvement grade in said fabric of at least about 0.1 to about 3 in accordance with the WRINKLE TEST METHOD with tensioning as defined herein.

22. The refreshing cabinet of claim 21, wherein the wrinkle improvement grade is at least 0.5.

23. The refreshing cabinet of claim 19, wherein a perfume is deposited onto the fabric.

24. The refreshing cabinet of claim 15, wherein said air flow path is positioned to direct air upward through said receiving region.

25. The refreshing cabinet of claim 15, wherein said dispensing heads dispense up to about 100 grams of a benefit composition per use.

26. The refreshing cabinet of claim 25, wherein said dispensing heads dispense said benefit composition in less than about 200 seconds.

27. A refreshing cabinet comprising:

a. a shell comprising an opening wherein said shell comprises a pair of sidewalls and liquid dispensing heads positioned on said sidewalls;

b. an extractable drawer adapted to fit said opening, said extractable drawer comprising: a drawer face comprising an outer surface; a supporting member for suspending a fabric or a fabric hung upon a fabric hanging member, wherein said fabric hanging member is a hanger, wherein said drawer face and said supporting member form a receiving region adapted to operably support a fabric; a heating element contained within said shell; and an air flow path positioned to direct air through said receiving region, wherein said refreshing cabinet provides a wrinkle improvement grade in said fabric of at least about 0.5 to about 3 in accordance with the WRINKLE TEST METHOD with tensioning as defined herein; and c. wherein said receiving region where said fabric is placed and said liquid dispensing heads are separated by a lateral distance less than about 30 cm.

28. The refreshing cabinet of claim 27, wherein the wrinkle improvement grade in said fabric is from about 0.8 to about 2.

29. The refreshing cabinet of claim 27, wherein said liquid dispensing heads are positioned within protrusions of the sidewalls.

30. The refreshing cabinet of claim 27, wherein said fabric hanging member is removably attached to said supporting member.

31. The refreshing cabinet of claim 27, wherein said air flow path is positioned to direct air upward through said receiving region.

32. The refreshing cabinet of claim 27, wherein said dispensing heads dispense up to about 100 grams of a benefit composition per use.

33. The refreshing cabinet of claim 32, wherein said dispensing heads dispense said benefit composition in less than about 200 seconds.

* * * * *